US005594299A

United States Patent [19]

Bossert et al.

[11] Patent Number: 5,594,299

[45] Date of Patent: Jan. 14, 1997

[54] DISPENSER CATHODE WITH POROUS SINTERED COMPACTED METAL DISPENSER BODY CONTAINING CHROMIUM OXIDE

[75] Inventors: Frank Bossert, Ulm; Manfred Hacker, Illerkirchberg; Rolf Lotthammer, Dornstadt, all of Germany

[73] Assignee: Licentia Patent-Verwaltungs-GmbH, Frankfurt am Main, Germany

[21] Appl. No.: 401,728

[22] Filed: Mar. 9, 1995

[30] Foreign Application Priority Data

Mar. 16, 1994 [DE] Germany ..... 44 08 941.4

[51] Int. Cl.[6] ..... H01J 19/06

[52] U.S. Cl. ..... 313/346 DC; 313/337

[58] Field of Search ..... 313/346 DC, 346 R, 313/270, 337; 445/50, 51

[56] References Cited

U.S. PATENT DOCUMENTS

| | | | |
|---|---|---|---|
| 2,995,674 | 8/1961 | Apelbaum et al. | 313/346 R |
| 3,155,864 | 11/1964 | Coppola | 313/346 R |
| 4,417,173 | 11/1983 | Tuck et al. | 313/346 R |
| 4,982,133 | 1/1991 | Choi | 313/346 DC |
| 5,318,468 | 6/1994 | Lotthammer et al. | 445/50 |

FOREIGN PATENT DOCUMENTS

| | | |
|---|---|---|
| 0282040A1 | 9/1988 | European Pat. Off. . |
| 0299126A1 | 1/1989 | European Pat. Off. . |
| 0322304A1 | 6/1989 | European Pat. Off. . |
| 1114163 | 4/1956 | France . |
| 2048224 | 4/1972 | Germany . |
| 3017429 | 11/1981 | Germany . |
| 4114856 | 11/1992 | Germany . |
| 4114856A1 | 11/1992 | Germany . |

*Primary Examiner*—Sandra L. O'Shea
*Assistant Examiner*—Jay M. Patidar
*Attorney, Agent, or Firm*—McGlew and Tuttle

[57] ABSTRACT

A dispenser cathode including a dispenser body formed of a metal matrix and an emission surface formed of emission material impregnated into the dispenser body metal matrix. The metal matrix is a porous sintered metal matrix containing at least one metal frown a first group (W, Mo, Cr) and at least one metal of a second group (Fe, Co, Ni, Ru, Rh, Pd, Re, Os, Ir, Pt) and chromium oxide. The chromium oxide and the metals from the two groups are provided as a powder mixture to form the matrix. The emission material includes at least two alkaline earth metal oxides such as CaO, BaO and at least one oxide of a metal of group IIIa or IIIb of the Periodic Table. The oxide of a metal group is $Al_2O_3$.

21 Claims, 5 Drawing Sheets

DISPENSER CATHODE WITH POROUS SINTERED COMPACTED METAL DISPENSER BODY CONTAINING CHROMIUM OXIDE

FIELD OF THE INVENTION

The present invention pertains to a dispenser cathode a dispenser body including a porous sintered compact (compacted sintered metal) or porous sintered metal matrix, which contains at least one metal of a first group, such as W, Mo, Cr and/or of a second group, such as Fe, Co, Ni, Ru, Rh, Pd, Re, Os, Ir or Pt, and which is impregnated with an emission material, which contains at least two alkaline earth metal oxides such as CaO, BaO and at least one oxide of a metal of group IIIa or IIIb of the Periodic Table, e.g., $Al_2O_3$.

BACKGROUND OF THE INVENTION

Dispenser oath are also called matrix cathodes or reserve cathodes. They consist, in general, of a dispenser body, also called a metal matrix, which is pressed or sintered from a metal powder and is impregnated with the actual emission material. Metals such as tangsten and molybdenum can be considered for use as the metal powder for the dispenser body. The use of mixtures of such metal powders has been known as well. Pressing the dispenser body into a cavity of a cathode sleeve has been known from German Offenlegungsschrift No. DE-OS 20,48,224. For example, building up the dispenser body in layers has been known from German Offenlegungsschrift No. DE-OS 41,14,856. The porous matrix body can be impregnated with an emission material, which consists of, e.g., BaO-CaO-$Al_2O_3$, by impregnation, melting in or the like.

It was found, in general, that so-called mixed-metal matrix cathodes (MM cathodes), i.e., cathodes whose dispenser bodies are pressed and sintered from a metal powder mixture, have improved dimensional stability and better current stability. The dispenser bodies of mixed-metal matrix cathodes consist, in general, of metals of a first group, such as tungsten, chromium or molybdenum, and metals of a second group, such as iron (Fe), cobalt (Co), nickel (Ni), ruthenium (Ru), rhodium (Rh), palladium (Pal), rhenium (Re), osmium (Os), iridium (It), and platinum (Pt).

Adding tungsten or tungsten oxide to the emission material has also been known from German Patent No. DE-PS 30,17,429.

It has also been known that the emission capacity of the cathodes can be improved by adding scandium compounds to the cathode body or to the emission material. However, the long-term properties of these so-called "Scandat cathodes" are not yet satisfactory.

SUMMARY AND OBJECT OF THE INVENTION

Therefore, the basic object of the present invention is to improve a dispenser cathode of the type described in the introduction especially in terms of the electron emission (high current density) with long life.

According to the invention, a dispenser cathode is provided with a dispenser body, formed having a porous sintered body. The porous sintered body contains at least one metal of a first group, such as W, Mo, Cr and/or of a second group, such as Fe, Co, Ni, Ru, Rh, Pd, Re, Os, Ir or Pt. The porous sintered body is impregnated with an emission material which contains at least two alkaline earth metal oxides, such as CaO, BaO and at least one oxide of a metal of group IIIa or IIIb of the Periodic Table, for example $Al_2O_3$. The invention provides that the chromium in the dispenser body is added as chromium oxide. The chromium oxide is preferably added to the dispenser body as a component of the porous sintered compact. The sintered compact before sintering consists essentially of a sintered metal powder mixture of tungsten, osmium and chromium oxide, according to a preferred embodiment of the invention. The percentage of tungsten is preferably equal to or greater than the percentage of Osmium. The percentage of chromium oxide is from 1 to 20 wt. percent, preferably 7 to 14 wt. percent and especially about 10 percent. The sintered compact or sintered body is preferably comprised of at least two layers which are arranged one on top of another. The two layers are sintered together. The two layers preferably consist of the same material but have different compositions in terms of the weight percents of the various components. In this case, the percentage of the metals of the first group, especially tungsten, is lower than the percentage of the metal of the second group, especially osmium, in the layer having the emission surface, whereas it is higher in the other, the underlying layer. The first layer preferably consists of 50–70% tungsten with the remainder being osmium. The osmium content of the second layer is preferably higher than 50%.

According to another feature of the invention, the chromium oxide is added to the emission material. The chromium oxide added to the emission material may be between 2 and 18 wt. percent, preferably 5 to 15 wt. percent and especially 8–12 wt. percent. The sintered compact preferably is formed of a sintered metal powder mixture especially metal tungsten and osmium. The tungsten content in weight percent is preferably equal to or higher than the osmium content. The sintered compact preferably consists of at least two layers formed of the same material which are arranged one on top of another and are sintered together. However, the composition of the materials in terms of the weight percents is different in at least two layers. The content and weight percent of the metal of the first group, especially of tungsten is preferably equal to or lower than the content of the metal of the second group, especially of osmium in the layer having the emission surface, whereas it is higher in the other, the underlying layer.

Experiments with various additives have shown that cathodes with markedly improved emission properties can be obtained by adding $Cr_2O_3$ powder especially to mixed metal powder. It was possible to approximately double the current densities at equal cathode temperature compared with a cathode without a chromium-containing additive especially in the case of dispenser cathodes with a dispenser body with a layered structure, as they are described in, e.g., DE 41,14,856 A1, and the current densities thus reached showed hardly any change even after a rather long operating time. The work function (for 1,000° C.) is correspondingly lower by ca. 0.1 eV in cathodes containing, e.g., 10% $Cr_2O_3$ additive to a W/Os powder than in cathodes without such additive.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
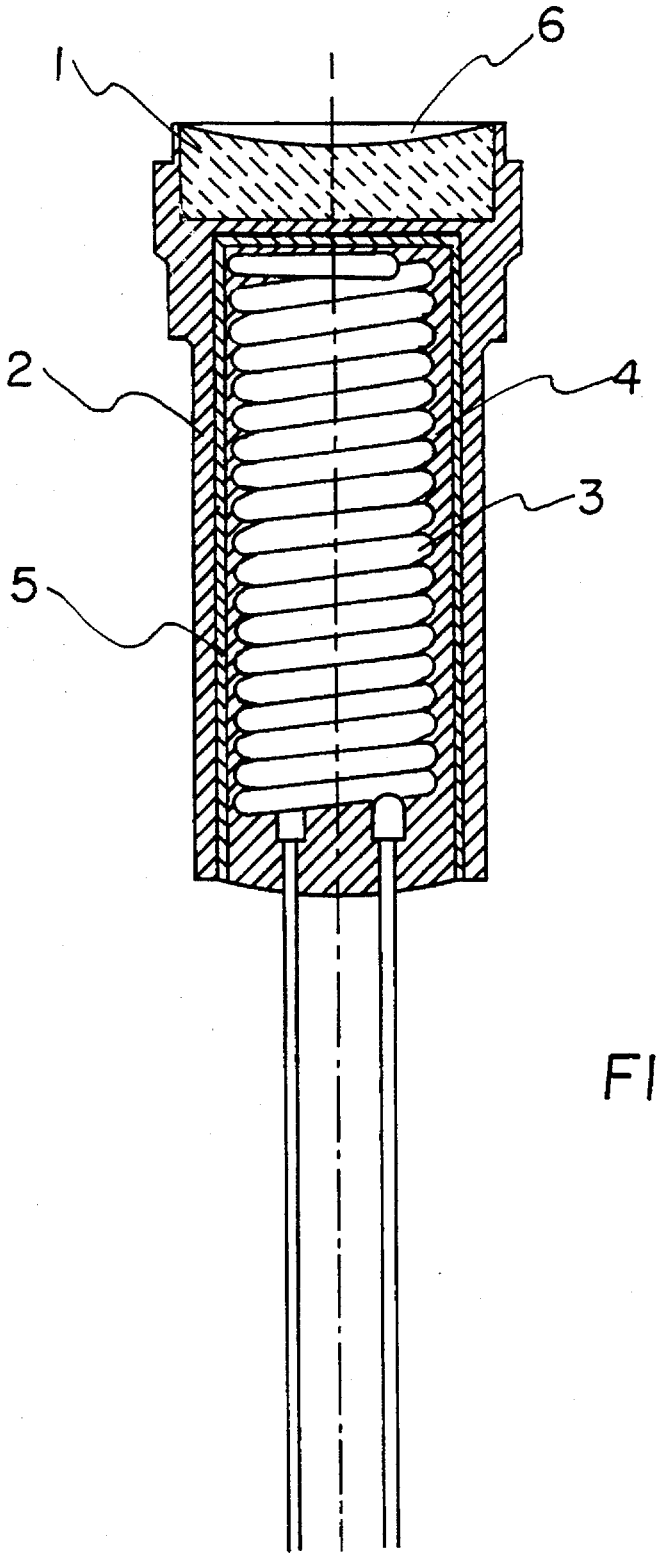
FIG. 1 is a schematic cross-sectional view through a dispenser cathode, whose cathode body may be comprised of two or three layers arranged one on top of another.

FIG. 1 schematically shows the design of a dispenser cathode with an emission surface 6. The cathode body 1, which may also be comprised of two or three layers, is prepared, e.g., by pressing a powder mixture (e.g., W+Os +$Cr_2O_3$) into the cathode holder 2 (made of, e.g., molybdenum). After sintering, filling with the emission material (e.g., BaO+CaO+$Al_2O_3$) is performed, e.g., by impregnation.

The heating filament 3 is embedded at 4 with, e.g., $Al_2O_3$ in a pot 5 made of molybdenum, which is fastened to the cathode holder 2.

Figure 2:
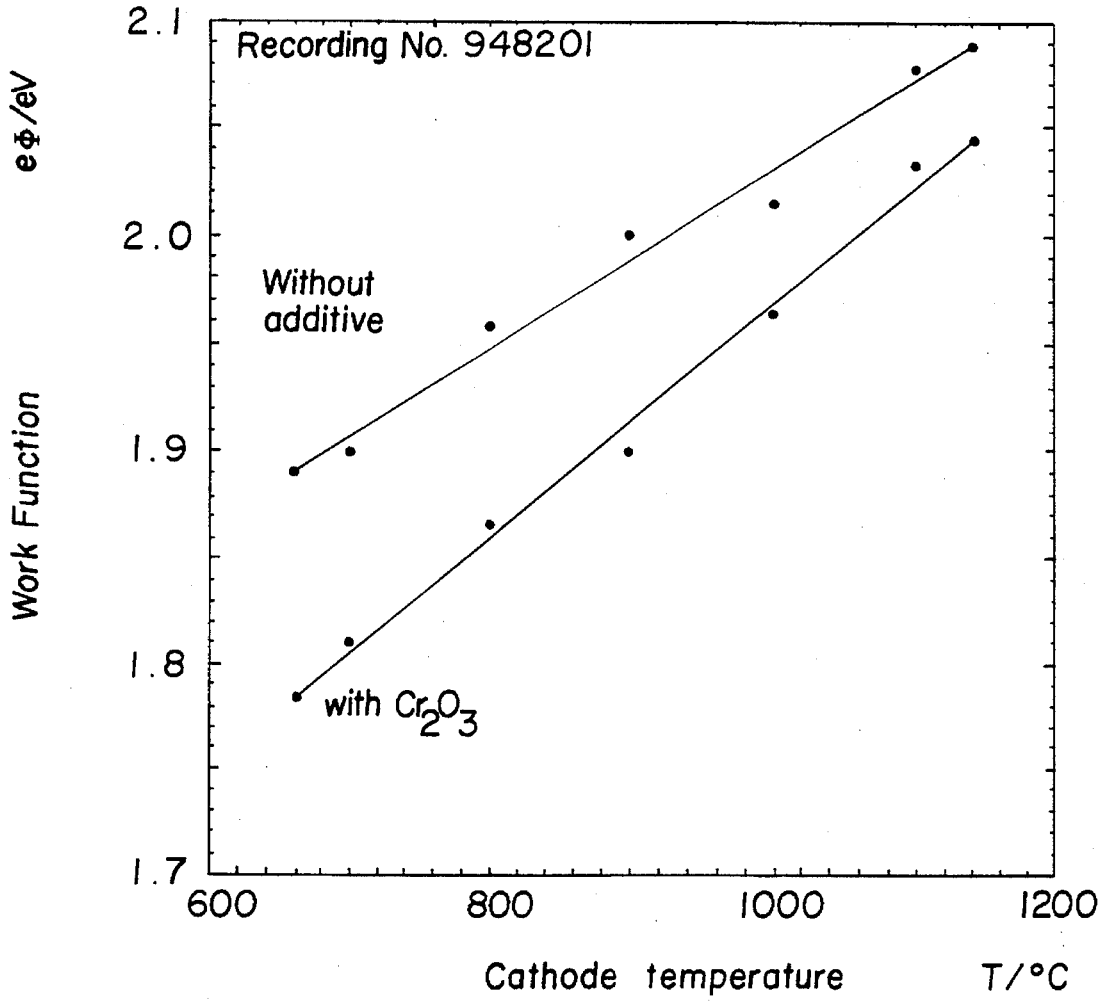
FIG. 2 is a diagram showing a curve of the work function as a function of the cathode temperature for a mixed-metal cathode (W/Os) with and without chromium-containing additive (before lifetime operation).

FIG. 2 shows the electron work function (eΦ/eV), whose value was determined from current-voltage characteristics (measured at 1,000° C.) according to known methods, as a function of the cathode temperature (Temperature in ° C.).

In newly prepared cathodes (very short operating time), the work function for cathodes containing $Cr_2O_3$ as an additive at low temperatures is ca. 0.1 eV lower than in the case of cathodes without additive, and it is still ca. 0.05 eV lower at high temperatures.

Figure 3:
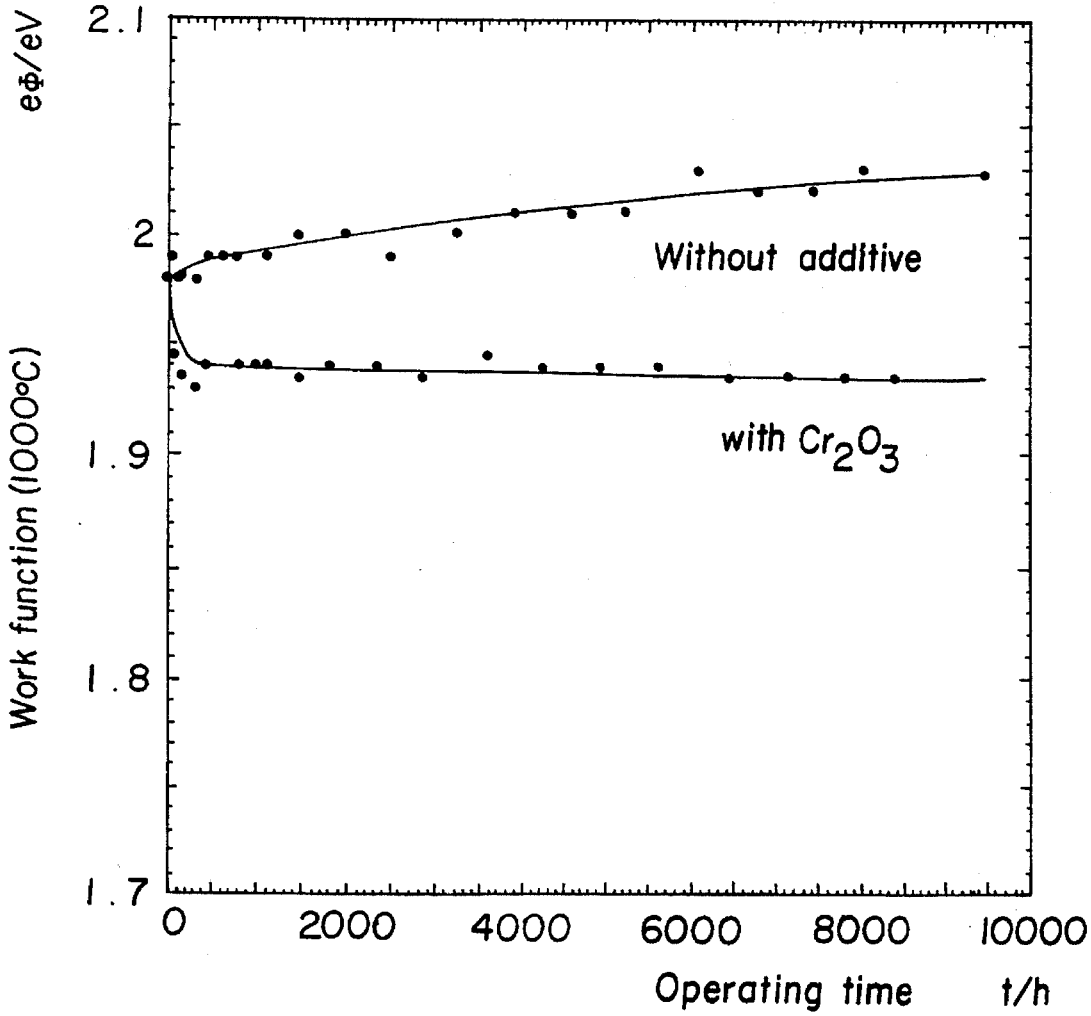
FIG. 3 is a diagram showing curve of the work function at 1,000° C. as a function of the operating time at increased cathode temperature (1,100° C.) for mixed-metal cathodes (W/Os) with and without chromium-containing additive.

FIG. 3 shows the change in the work function (eΦ/eV) (for 1,000° C.) during operation at increased temperature (1,100° C., used to accelerate aging) as a function of the operating time (in hours). The work function for cathodes containing $Cr_2O_3$ as an additive still decreases slightly at the beginning of the operation, after which it remains practically constant during the observation period (almost 10,000 hours). The work function for cathodes without additive increases, so that its value is ca. 0.1 eV higher after 1,000 hours than in the case of cathodes containing $Cr_2O_3$.

Figure 4:
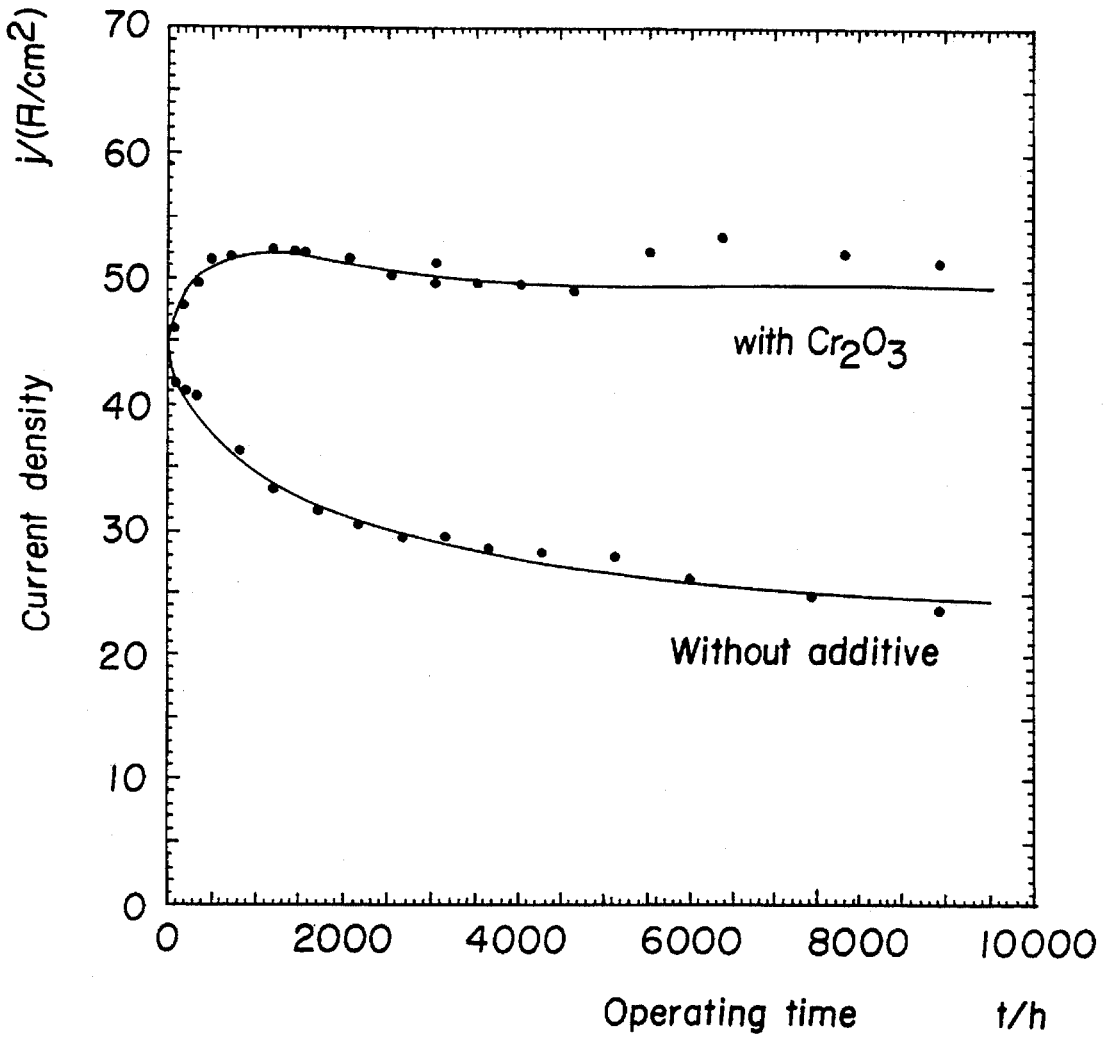
FIG. 4 is a diagram showing a curve of the saturation current for 35 kV/cm as a function of the operating time for mixed-metal cathodes (W/Os) with and without chromium-containing additive.

FIG. 4 shows the changes in the saturation current (current density j in A/cm$^2$) as a function of the time as an example for the value of the current that can be reached at a field intensity of 35 kV/cm as a function of the operating time t(h). The changes in the saturation current correspond to those in the work function (FIG. 3); the saturation current changes less in the case of cathodes containing $Cr_2O_3$ as an additive than that of cathodes without additive. After a rather long operating time (nearly 10,000 hours at 1,100° C. in the example), the saturation current of cathodes containing $Cr_2O_3$ as an additive is still approximately twice as high as the current of the cathodes without additive. (Neither type exhibits practically any drop at low temperature.)

In a first embodiment, the chromium or chromium oxide additive is added to the sintered compact of the cathode body. This is preferably done by adding powdered chromium oxide ($Cr_2O_3$) to the powder or powders of the metals of the first group and of the second group, then pressing this mixture, and subsequently sintering it into a porous sintered compact. The percentage of chromium oxide in the powder mixture is 1–20 wt. %, preferably 7–14 wt. %, and especially ca. 10 wt. %. The other powder components preferably consist of tungsten and osmium, and the percentage of tungsten should not preferably be lower than the percentage of osmium. The metal of the second group, i.e., osmium, may be dispensed with altogether, if desired.

In another exemplary embodiment, the chromium or chromium oxide is mixed with the emission material, which is also processed as a powder mixture, and with which the porous sintered compact is then impregnated, instead of adding it to the powder mixture for the sintered compact. The sintered compact must not contain any chromium or chromium oxide in this case. Metallic chromium or chromium oxide may be added to the emission material. Chromium is preferably added in amounts of 1–12 wt. %, preferably 4–10 wt. %, and especially 6–8 wt. %. Chromium oxide is preferably added in amounts of 2–18 wt. %, preferably 5–15 wt. %, and especially 8–12 wt. %.

Should the sintered compact already contain a certain amount of chromium oxide, a lower chromium content should be selected for the emission material. The basic matrix, namely, the sintered compact, preferably consists of a tungsten-osmium mixture possibly with a very low osmium content.

The chromium additive according to the present invention can especially be advantageously used in a dispenser cathode whose dispenser body consists of a plurality of sintered layers that are arranged one on top of another and are sintered together, as is described in, e.g., German OffenlegungsschriftNo. DE-OS 41,14,856 A1. The layered sintered compact described in this publication consists of at least two layers, which consist of essentially the same materials. However, according to the invention, the weight percents of the materials are preferably different in at least two adjacent layers, in such a way that the percentage of the metal of the first group is higher than the percentage of the metal of the second group in the underlying layer and the percentage of the metal of the second group is higher than the percentage of the metal of the first group in the layer having the emission surface. Chromium or chromium oxide should be present at least in the layer having the emission surface 6, in such a cathode body with layered sintered compact as well, and the chromium oxide or chromium may be contained either in the sintered compact or, if desired, it may be introduced into the layers only with the emission material. Such a dispenser cathode with a multilayer cathode body is preferably fabricated by using a process known from DE-OS 4 114 856, in which the sintered body is prepared with an additional layer, and this additional layer is removed after the sintering.

Figure 5:
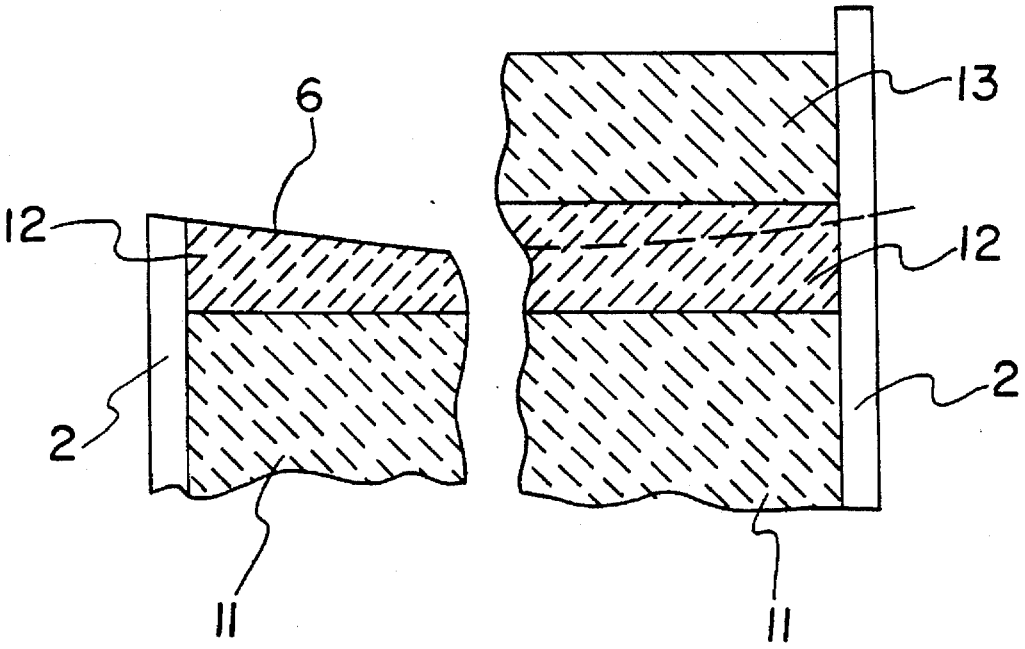
FIG. 5 is a schematic cross-sectional view through a cathode body comprising two layers and its fabrication from a sintered body comprising an additional layer.

FIG. 5 shows, in its right-hand part, a cross section through a sintered body comprising a first layer 11, a second layer 12 and a third layer 13 in a cathode holder 2. The first layer is prepared essentially from a metal power mixture consisting of more the 50 wt. % and preferably more than 70 wt. % of tungsten, the rest being osmium. The third layer 13 preferably has exactly the same composition as the first layer. The second layer 12 is prepared from a mixture of tungsten metal powder, osmium metal powder and approx. 10 wt. % of chromium oxide powder, wherein the osmium content is higher than in layers 11 and 13 and preferably higher than 50 wt. %. The different powder mixtures are filled into the cathode holder one after another, pressed under high pressure, and sintered together.

The third layer 13 and part of the second layer 12 up to the interrupted line are removed after sintering, e.g., by grinding, so that a two-layer cathode body shown schematically in the left-hand part of FIG. 5 with the emission surface 6 forming the exposed surface of the second layer is formed. The filling (impregnation) of the metal matrix with the emission material is preferably performed prior to the removal of this third layer and of part of the second layer.

While specific embodiments of the invention have been shown and described in detail to illustrate the application of the principles of the invention, it will be understood that the invention may be embodied otherwise without departing from such principles.

What is claimed is:

1. A dispenser cathode comprising:

a dispenser body including a porous sintered metal matrix, said porous sintered metal matrix containing at least one metal from a first group consisting of W, Mo, Cr containing at least one metal of a second group, consisting of Fe, Co, Ni, Ru, Rh, Pd, Re, Os, Ir and Pt, and containing chromium oxide; and an emission material impregnating said dispenser body metal matrix, said emission material including at least two alkaline earth metal oxides such as CaO, BaO and at least one oxide of a metal of group IIIa or IIIb of the Periodic Table.

2. A dispenser cathode according to claim 1, wherein said oxide of a metal group included in said emission material is $Al_2O_3$.

3. A dispenser cathode according to claim 1, wherein said sintered metal matrix consists essentially of a sintered powder mixture of tungsten, osmium and said chromium oxide.

4. A dispenser cathode according to claim 3, wherein a percentage of tungsten is equal to or greater than a percentage of osmium.

5. A dispenser cathode according to claim 1, wherein 1–20 wt. percent of chromium oxide is added.

6. A dispenser cathode according to claim 1, wherein 7–14 wt. percent of chromium oxide is added.

7. A dispenser cathode according to claim 1, wherein an amount of chromium oxide added is substantially equal to 10 wt. percent.

8. A dispenser cathode according to claim 1, wherein said sintered metal matrix is formed of at least two layers, said layers being arranged one on top of another and being sintered together, said layers being formed of the same material but having different compositions in terms of weight percents.

9. A dispenser cathode according to claim 8, wherein at least one metal of said first group and at least one metal of said second group are contained in said sintered metal matrix, a percentage of said metal of said first group being lower than a percentage of said metal of said second group in a layer with said emission material impregnating said dispenser body, said emission material forming an emission surface.

10. A dispenser according to claim 9, wherein said metal of said first group is tungsten and said metal of said second group is osmium.

11. Dispenser cathode according to claim 1, wherein said sintered metal matrix is formed of at least two layers, said layers being arranged one on top of another and being sintered together, said layers being formed of the same material but having different compositions in terms of weight percents.

12. Dispenser cathode according to claim 11, wherein at least one metal of said first group and at least one metal of said second group are contained in said sintered metal matrix, a percentage of said metal of said first group being lower than a percentage of said metal of said second group in said emission surface.

13. Dispenser cathode according to claim 12, wherein said metal of said first group is tungsten and said metal of said second group is osmium.

14. A dispenser cathode comprising:

a dispenser body including a porous sintered metal matrix, said porous sintered metal matrix being prepared from a powder mixture of at least one metal from a first group consisting of W, Mo, Cr at least one metal of a second group, consisting of Fe, Co, Ni, Ru, Rh, Pd, Re, Os, Ir or Pt, and chromium oxide; and an emission material forming an emission surface on said dispenser body, said emission material impregnating said dispenser body metal matrix to form the dispenser cathode.

15. A according to claim 14, wherein said emission material contains at least two alkaline earth metal oxides, comprising CaO, BaO and at least one oxide of a metal group IIIa or IIIb of the Periodic table.

16. A dispenser cathode according to claim 15, wherein said oxide of a metal group is $Al_2O_3$.

17. A dispenser cathode according to claim 14, wherein said sintered metal matrix consists essentially of a sintered powder mixture of tungsten, osmium and said chromium oxide.

18. A dispenser cathode according to claim 17, wherein a percentage of tungsten is equal to or greater than a percentage of osmium.

19. A dispenser cathode according to claim 14, wherein 1–20 wt. percent of chromium oxide is added.

20. A dispenser cathode according to claim 14, wherein 7–14 wt. percent of chromium oxide is added.

21. Dispenser cathode according to claim 14, wherein an amount of chromium oxide added is substantially equal to 10 wt. percent.

* * * * *